United States Patent [19]

Gray

[11] Patent Number: 4,843,860

[45] Date of Patent: Jul. 4, 1989

[54] TWO STAGE IMPACT BELLER

[75] Inventor: Kenneth P. Gray, East Syracuse, N.Y.

[73] Assignee: Carrier Corporation, Syracuse, N.Y.

[21] Appl. No.: 202,894

[22] Filed: Jun. 6, 1988

[51] Int. Cl.[4] ..... B21D 41/02

[52] U.S. Cl. ..... 72/318; 72/370

[58] Field of Search ..... 72/306, 316–318, 72/370, 476; 29/157.4 R, 157 R, 727

[56] References Cited

U.S. PATENT DOCUMENTS 1,791,887 2/1931 Davies et al. ..... 72/318
2,016,795 10/1935 Belknap ..... 72/318
2,620,013 12/1952 DeVoss ..... 72/318
3,119,435 1/1964 Greenman ..... 72/318

FOREIGN PATENT DOCUMENTS 133952 3/1985 European Pat. Off. ..... 72/316
1602727 11/1981 United Kingdom ..... 72/316

*Primary Examiner*—Daniel C. Crane
*Attorney, Agent, or Firm*—Thomas J. Wall

[57] ABSTRACT

A two stage impact beller has a rod driven pinch bullet that pre expands an end of a heat exchanger tube, and a belling tool which follows the pinch bullet. This die is generally bell shaped with a flared out proximal end. A jaw assembly holds the tube during a belling process.

8 Claims, 2 Drawing Sheets

TWO STAGE IMPACT BELLER

BACKGROUND OF THE INVENTION

This invention relates to apparatus for expanding and flaring tubing, for example, copper heat exchanger tubes. The invention is more particularly directed to apparatus for belling the ends of heat exchanger tubes and expanding the tubes in a plate-fin heat exchanger.

Plate-fin heat exchangers are often employed in air conditioning systems and refrigeration systems, e.g., for trucks, seagoing vessels, and railroads. These plate-fin units are typically formed by lacing so-called hairpin tubes or U-tubes into aligned holes in a stack of fin plates and tube sheets, with the U-bend sections extending out one side of one of the tube sheets. The open ends of the tubes extend out the other tube sheet. The walls of the tube, which is typically copper, are then expanded radially into contact with the metal of the fin collars and the tube sheets. This establishes good thermal contact and mechanical support. The hairpin tube ends are belled, either before or after tube expansion, the return bends are soldered or brazed into the belled ends to close the flow circuit of the unit.

In compression expansion, the hairpin tubes are supported from the U-bend side, and the belling typically takes place after the expansion. This technique can result in uncertainty in establishing an offset or standoff distance between the tube belled ends and the tube sheet. Because of varying amounts of tube shrinkage during expansion, the bells are often incompletely formed, requiring significant reworking in some cases, and resulting in scrapping of the fin pack in other cases. A compression-expansion technique is described in U.S. Pat. No. 4,228,573.

Tension expansion involves gripping a length of the open end of the tubes, generally a three-inch length, and belling the hairpin tubes prior to expansion, and then supporting the tubes by the tube sheet or their belled ends while expander rods are driven into the two legs of each hairpin tube. The tubes can be belled directly against the associated tube sheet so that the tube sheet supports the hairpin tubes during expansion, or else the bells can be formed at an established standoff distance above the tube sheet. In the latter case, the belled ends can be supported in a clamping jaw or similar device during expansion. One technique for belling and expanding hairpin tubes in a finpack heat exchanger is described in U.S. Pat. No. 4,584,765.

To date there has been no equipment or apparatus proposed which permits the belling of short lengths of the hairpin tube, generally less than one inch in length, to be carried out simply and reliably, or which permits the belled ends of the heat exchanger tubes to be offset reliably at an established, finite distance from the associated tube sheet and eliminates the scratching of the bell that typically can occur if a long, serrated clamp is used, and which weakens the tube.

OBJECTS AND SUMMARY OF THE INVENTION

Accordingly it is an object of this invention to bell heat exchanger tubes, either in a plate-fin heat exchanger or in another environment, while avoiding the drawbacks of the prior art.

It is another object of this invention to provide a belling apparatus which is simple and reliable, which can consistently form flared bells at a desired standoff distance, and which can be employed before a tube expansion operation.

According to one aspect of this invention, a two-stage impact beller creates flared bells at the open ends of heat exchanger tubes of a given inside diameter and outside diameter. A clamp releasably grips the tube near the open end to hold it against axial movement. Then a pinch bullet, mounted on the end of a drive rod, enters the open end, expanding the tube slightly. The pinch bullet stops at the position of the clamp, and pinches the tube at that point to hold it securely against the clamp for the next step. The force of driving the pinch bullet is relatively small, as the clamp is only slightly smaller (i.e., 0.005 inches) than the tube outside diameter. Thus a small gripping surface on the clamp is sufficient to restrain the tube. However, with the tube pinched between the clamp and the bullet, a high belling force (several times the magnitude of the pinchbullet force) can be sustained. A belling tool or punch which is shaped to expand and then flare the end of the tube, travels along the drive rod behind the pinch bullet. The belling die advances into the end of the tube to form a bell, and then the bullet and die are withdrawn and the clamp is opened.

A small indentation may be present on the tube at the pinch point. However, this more or less disappears in a subsequent tube expansion operation.

The above and many other objects, features, and advantages of this invention will be more fully appreciated from the ensuing description of a preferred embodiment, when read in connection with the accompanying Drawing.

DETAILED DESCRIPTION OF THE PREFERRED EMBODIMENT

Figure 1:
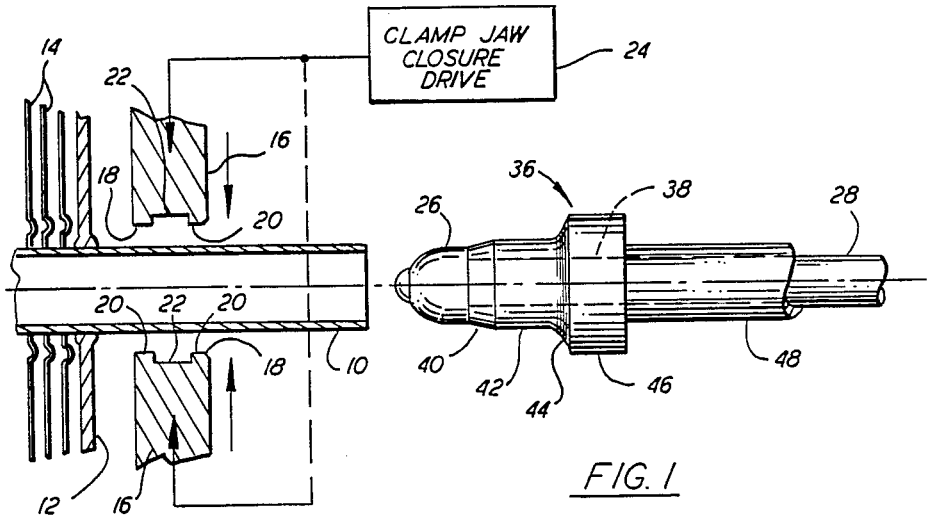
FIG. 1 is a side view of a plate-fin heat exchanger tube and an impact belling device according to an embodiment of this invention.

With respect to the Drawing, FIG. 1 shows a typical heat exchanger tube 10, which can be one leg of a hairpin tube, protruding beyond a sheet metal tube sheet 12. A stack of fin plates 14 are aligned adjacent the tube sheet 12, and a number of these tubes 10 are laced through aligned holes and fin collars in the fin plates 14 and tube sheet 12. The open end of the tube 10 is to be belled to form a female joining structure into which a male member, such as a return bend, can be inserted and soldered or brazed.

Figure 5:
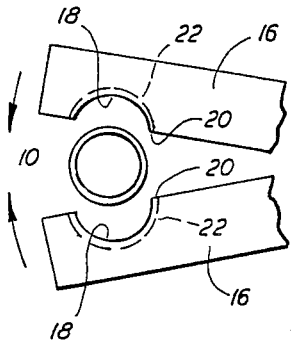
FIG. 5 is a schematic view of a gripper jaw for clamping the tube during a belling operation.

First, the free end 10 of the heat-exchanger tube is held against axial movement, here by means of a clamp jaw assembly formed of a pair of opposed jaws 16. These jaws have mating semi-cylindrical gripping faces 18 (See FIG. 5) with two semiannular rib portions 20 that define circular gripping orifice of a diameter just slightly less than the outside diameter of the tube 10, preferably by about 0.005 inches. There is a semiannular gap 22 on each jaw 15 between the two semi-annular rib portions 20. This gap permits the metal of the tube to distort or flow slightly, thereby avoiding crushing or gouging of the surface of the tube. A clamp closure device 24 (FIG. 1) can include hydraulic or pneumatic cylinders or motors and suitable linkages to close and open the jaws 16.

Figure 2:
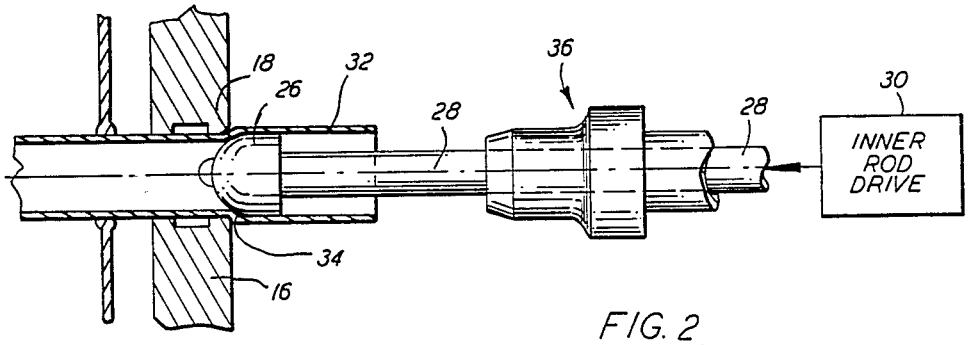
FIGS. 2, 3, and 4 are views similar to FIG. 1 showing a belling operation including pinching, belling or flaring, and withdrawing the beller from the belled tube.

A pinch bullet 26 of slightly greater diameter than the tube inside diameter is mounted at the distal end of a drive rod 28, and as shown in FIG. 2, a rod drive 30 rams the rod 28 and pinch bullet 26 into the open end of the heat-exchanger tube 10 after the gripping jaws 16 close. The pinch bullet 26 forms an intermediate expansion 32 on the end of the tube, and lodges at the clamping jaws 16 to form a pinch or shoulder 34 in the tube between the bullet 26 and the jaws 16. Favorably, the intermediate expansion 32 has a new inside diameter that is slightly greater than the original outside diameter, so that the expansion 32 can eventually be used as a female coupling.

A belling tool or punch 36 is situated on the rod 28 behind or proximally of the pinch bullet 26. This punch 36 is generally bell shaped with a circular cross section. The punch 36 has an axial bore 38 which is slidably disposed on the rod 28. The die has an entry taper 40 at its distal end. This taper 40 is conical and expands from within the diameter of the bullet 26 which it faces, to the final bell inside diameter. From here, a generally cylindrical main portion 42 extends to a tail flare 44 at the proximal end of the die. This flare is responsible for flaring out the tube end. Finally there is an end portion 46 supporting the tail flare 44. A drive sleeve 48 fits over the pinch pullet drive rod 28, powered by a suitable drive mechanism 50 (FIG. 3) the drive sleeve 48 rams the belling punch 36 into the tube end. This forms a final tube bell 52 at the end of the tube 10. In this embodiment, the jaws 16 hold the tube 10 at a predetermined distance from the tube sheet 12 so that there is a predetermined standoff distance 54 established between the bell 52 and the tube sheet 12.

Figure 3:
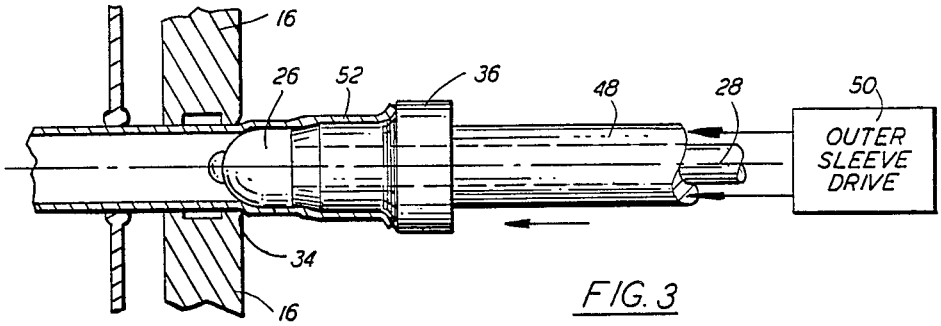
Figure 4:
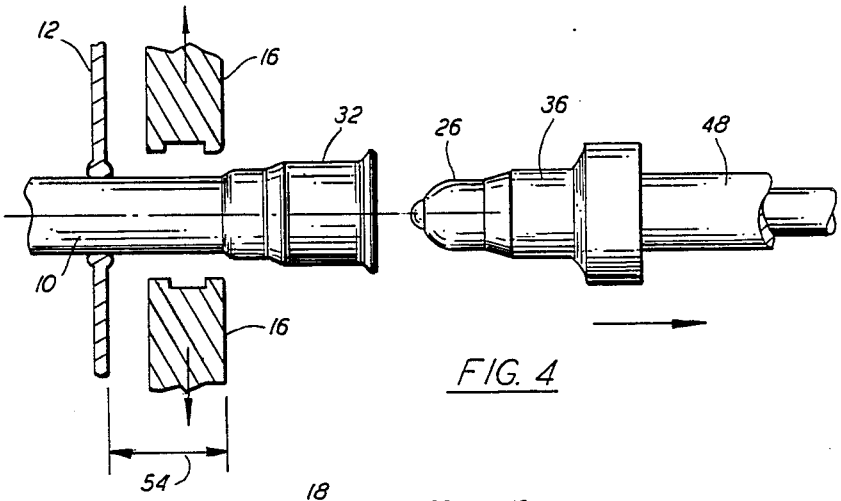

The bell 52 is formed quite simply. First, the tube 10 is aligned with the beller. The clamping jaws 16 are closed as in FIG. 1. Then the pinch bullet 26 is driven in until the tube 10 is pinched between the bullet 26 and the jaws 16, as shown in FIG. 2. Thereafter, as shown in FIG. 3, the outer sleeve and belling punch 36 are driven to further enlarge and flare the end of the tube. After this, the belling assembly is withdrawn as shown in FIG. 4, leaving the bell 52 at the end of the tube 10.

Generally a holding force of about 100 pounds is required for the pinch bullet 26. Although several times that much force is required for the belling die 36, sufficient clamping force is achieved by the pinch 34.

While this invention has been described with reference to a particular embodiment, it should be recognized that many modifications and variations would present themselves to those of skill in the art without departing from the scope and spirit of this invention, as defined in the appended claims.

What is claimed is:

1. A two-stage impact beller for creating a bell on an open end of a heat exchanger tube that has a predetermined inside diameter and a predetermined outside diameter, comprising:

clamping means for releasably holding the tube against axial movement and defining an annular gripping face;

a pinch bullet having a diameter exceeding the tube inside diameter;

a drive rod movable in an axial direction into said tube end and having a distal end on which said pinch bullet is mounted, such that said pinch bullet expands said tube end and forms a shoulder therein which lodges against a proximal side of said annular gripping face of said clamping means;

a bell-shaped tool slidably mounted on said rod behind said pinch bullet and having a flared-out proximal end which creates a flare on said tube end when driven into same; and means for driving said bell-shaped tool into said tube end after said pinch bullet has entered same;

wherein said shoulder lodging against said clamping means provides sufficient axial holding force on said heat exchanger tube for receiving said bell shaped tool therein for creating said flare on said tube end.

2. A two-stage impact beller according to claim 1 wherein said clamping means includes a clamping jaw having mating cutouts of generally semicircular cross section which grip the heat exchanger tube.

3. A two-stage impact beller according to claim 2 in which said semi-circular cutouts have a diameter slightly less than the outside diameter of the heat exchanger tube.

4. A two-stage impact beller according to claim 3 in which said clamping jaw cutout diameter is about 0.005 inches less than the outside diameter of the heat exchanger tube.

5. A two-stage impact beller according to claim 3 in which said clamping jaw cutouts each have a pair of semi-annular portions of said diameter less than said outside diameter, and have a semi-annular gap between them.

6. A two-stage impact beller according to claim 1 wherein said bell-shaped tool includes a unitary member of generally circular cross section having an axial bore which slidably overfits the drive rod.

7. A two-stage impact beller for creating a bell on an open end of a heat exchanger tube that has an inside diameter and an outside diameter, comprising:

clamping means for releasably holding the tube against axial movement;

a pinch bullet having a diameter exceeding the tube inside diameter to effect expansion of said tube;

a drive rod movable in an axial direction into said tube end and having a distal end on which said pinch bullet is mounted;

a bell-shaped tool slidably mounted on said rod behind said pinch bullet and having a flared-out proximal end which creates a flare on said tube end when driven into same, wherein said bell-shaped tool is formed as a unitary member of generally circular cross section having an axial bore that slidably overfits said drive rod, and includes a conical distal section tapered from a diameter less than said diameter of the pinch bullet to substantially the diameter of said pinch bullet, and a generally cylindrical section leading proximally to said flared out proximal end;

and means for driving said bell shaped tool into said tube end after said pinch bullet has entered same.

8. A two-stage impact beller for creating a bell on an open end of a heat exchanger tube that has an inside diameter and an outside diameter, comprising:

clamping means for releasably holding the tube against axial movement;

a pinch bullet having a diameter exceeding the tube inside diameter;

a drive rod movable in an axial direction into said tube end having a distal end on which said pinch bullet is mounted;

a bell-shaped tool slidably mounted on said drive rod behind said pinch bullet and having a flared-out proximal end which creates a flare on said tube end when driven into same, wherein said bell-shaped tool is formed as a unitary member of generally circular cross section having an axial bore that overfits said drive rod; and means for driving said bell-shaped tool into said tube end after said pinch bullet has entered same including a drive sleeve slidably overfitting said drive rod.

* * * * *